United States Patent [19]

Chaussadas

[11] Patent Number: 4,880,115

[45] Date of Patent: Nov. 14, 1989

[54] MULTIPACK FOR CANS INCORPORATING PLASTICS SECURING BAND

[75] Inventor: Jean Chaussadas, Deols, France

[73] Assignee: The Mead Corporation, Dayton, Ohio

[21] Appl. No.: 217,181

[22] Filed: Jul. 11, 1988

[30] Foreign Application Priority Data

Jul. 10, 1987 [GB] United Kingdom ..... 8716355
Jul. 2, 1988 [GB] United Kingdom ..... 8815582

[51] Int. Cl.[4] ..... B65D 65/00; B65D 75/00

[52] U.S. Cl. ..... 206/427; 206/139; 206/140; 206/434; 229/40

[58] Field of Search ..... 206/139, 140, 161, 427, 206/428, 434; 229/40

[56] References Cited

U.S. PATENT DOCUMENTS 3,193,979 7/1965 Dollheimer .
3,194,476 7/1965 Weiss ..... 206/140 X
3,547,310 12/1970 Currie .
4,355,717 10/1982 Oliff ..... 206/140
4,382,506 5/1983 Chaussadas ..... 206/200
4,628,666 12/1986 Lems ..... 53/398

FOREIGN PATENT DOCUMENTS 0035912 9/1981 European Pat. Off. .
2120303 11/1971 Fed. Rep. of Germany .

*Primary Examiner*—Arnold Rosenthal
*Attorney, Agent, or Firm*—Erwin Doerr

[57] ABSTRACT

A composite package comprising a group of cans (C1–C6), a band (PB) of a plastics material which passes around the group of cans intermediate their tops and bases, an outer paperboard wrapper (10) passing around the group. The wrapper includes spacer portions each of which locates in a space at the top and base ends between an adjacent pair of cans so as to urge the cans apart whereby the cans exert a force on the plastics band tending to expand the band into tension around the group of cans.

7 Claims, 4 Drawing Sheets

MULTIPACK FOR CANS INCORPORATING PLASTICS SECURING BAND

This invention relates to a multi-unit package for retaining in a group a plurality of cans or other uniform articles and which incorporates a plastics securing band and an outer wrapper.

European Pat. No 0 035 912 discloses a multi-unit composite package for bottles, cans or other primary containers which comprises a first plastics film wrapping which encases the containers and holds them in a closely clustered unit and an outer paperboard sleeve passing around the clustered unit which includes a carrying handle of the package.

The present invention seeks to achieve a multi-unit package in which the overall cost of the packaging material is reduced to a minimum consistent with providing a secure package. To this end, a relatively short outer wrapper is used so that the endmost containers are almost wholly exposed to view and a plastics band is employed to provide for the securement of those endmost containers which is lost by the reduction in size of the paperboard wrapper.

In the known construction referred to, by virtue of the encasing inner plastics wrapping, no further packaging material was required solely for retention purposes but an outer paperboard wrapper was provided to furnish the package with a handle, hide openings present in the plastics wrapping and to provide surfaces on which marketing, advertizing and other information may be printed.

In the present invention, the outer paperboard wrapper is provided primarily to prevent "nesting" of the containers and, of course, to give surfaces on which marketing and other information may be printed. "Nesting" occurs, e.g. when one row of containers moves relative to a neighbouring row so that one container in the first row is disposed out of registry with a pair of adjacent containers in the neighbouring row.

Another known multipack for containers incorporating a plastics securing band is disclosed in U.S. Pat. No. 4,628,666 (Lems) in which a unitary loop matrix is positioned over one end of each of the containers which causes the containers to spread apart so that the plastics securing band is tensioned further. However, this invention is not concerned with a package incorporating an outer paperboard wrapper.

The invention provides a composition package comprising a group of primary containers such as cans, a band of a plastics material which passes around the group of containers intermediate the top and base ends thereof, an outer paperboard wrapper passing around the group and providing for the package, a series of hinged panels including a top panel, a pair of overlapping base panels and a pair of opposed side wall panels characterised in that panel portions of panels disposed adjacent at least one of said top and base ends of the containers are located between adjacent containers which are flanked by one of said side wall panels, said panel portions providing spacer means for urging said containers apart so that the containers exert a force on said plastics band tending to expand the band into tension around the group of containers.

According to a feature of the invention, in some constructions, the spacer means may comprise connecting portions of the wrapper each of which portions is integrally hinged to adjacent ones of said series of panels. In other constructions, the spacer means may comprise cut-away portions of the wrapper each of which portions is displaced into the space present between said adjacent containers.

If either of the above constructions are adopted, the spacer means may be disposed both in the space between the top ends of said adjacent containers and between the base end of said adjacent containers.

In constructions where the spacer means comprise hinged connecting portions, cut out retaining means may be provided for locating upper and lower peripheral portions of said containers said retaining means comprising cut out portions of the wrapper along opposed edges thereof, and centrally thereof at each hinged connection between an adjacent pair of said series of panels. Preferably, said spacer means comprise portions of the wrapper disposed between adjacent retaining means provided along each of said hinged connections between an adjacent pair of said series of panels. It is also preferable that each of said spacer means is reinforced by material struck from the wrapper to form the cut out retaining means.

In constructions where the spacer means comprise cut-away portions of the wrapper, said cut-away portions each may be hinged to an adjacent pair of said series of panels.

Two embodiments of the invention will now be described, by way of example, with reference to the accompanying drawings in which.

Figure 1:
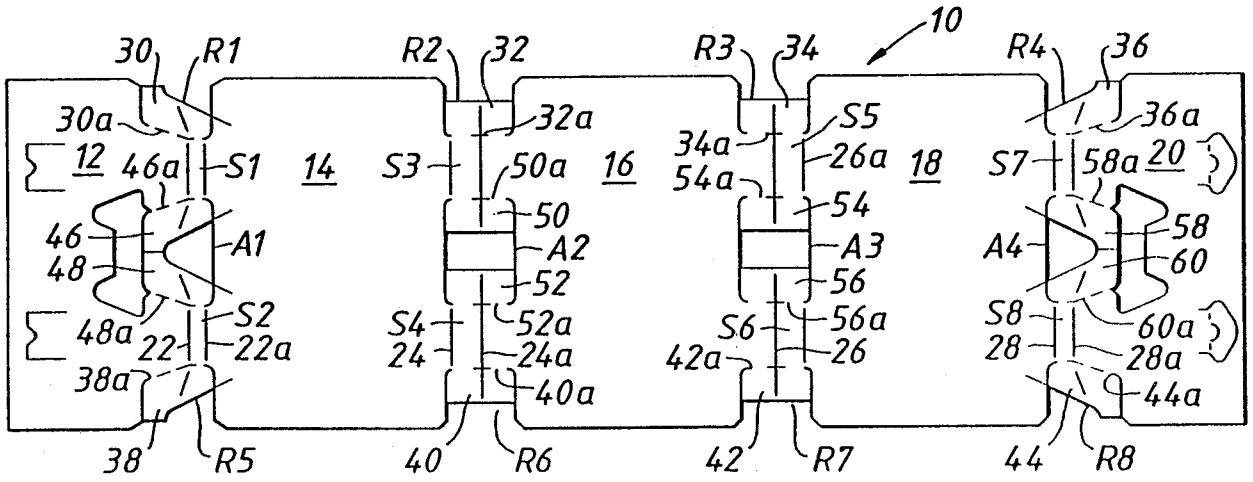
FIG. 1 is a plan view of a paperboard blank utilized in a package according to one embodiment of the invention to provide an outer wrapper.

Referring first to FIG. 1 of the drawings, an elongate blank 10 of paperboard or similar foldable sheet material comprises, in series, a first base panel 12, a first side wall panel 14, a top panel 16, a second side wall panel 18 and a second base panel 20 hinged one to the next along transverse fold lines 22, *22a*, 24, *24a*, 26, *26a*, 28 and *28a*.

Foldable reinforcing tabs 30, 32, 34 and 36 are struck along one longitudinal edge of the blank at fold lines 22, 24, 26 and 28 respectively, and similar tabs 38, 40, 42 and 44 are struck along the opposite longitudinal edge of the blank.

All the reinforcing tabs 30–36 and 38–44 are foldable inwardly towards the centre of the blank about fold lines identified by the reference numeral of the respective tab with the addition of suffix 'a'. When reinforcing tabs 30–36 are so folded, recesses R1–R4 are formed along the associated longitudinal edge of the blank and likewise when reinforcing tabs 38–44 are inwardly folded, recesses R5–R8 are formed.

Centrally along the blank, a series of substantially rectangular apertures A1, A2, A3 and A4 are struck at fold lines 22, 24, 26 and 28 respectively. Aperture A1 is defined in part by opposed foldable reinforcing tabs 46 and 48 which are hinged at opposite transverse ends of the aperture along fold lines 46*a* and 48*a* respectively. Likewise aperture A2 is partially defined by reinforcing tabs 50 and 52 hinged along fold lines 50*a* and 52*a*; aperture A3 is partially defined by reinforcing tabs 54 and 56 hinged along fold lines 54*a* and 56*a*; and aperture A4 is partially defined by reinforcing tabs 58 and 60 hinged along fold lines 58*a* and 60*a*. Tabs 46–60 are foldable outwardly towards the adjacent longitudinal blank about their fold lines to open the respective apertures A1–A4.

Thus when tabs 30 and 46 are folded towards one another they are brought into superposed relationship with and thereby reinforce the strip of material disposed between edge recess R1 and aperture A1. Likewise, tabs 38 and 48 reinforce the strip of material between edge recess R5 and aperture A1. These two reinforced strips of material provide spacer portions S1 and S2, respectively of the blank between base panel 12 and side wall panel. Similarly, spacer portions S3 and S4 integrally connect together side wall panel 14 and top wall panel 16; spacer portions S5 and S6 integrally connect together top wall panel 16 and side wall panel 18; and spacer portions S7 and S8 integrally connect together side wall panel 18 and base panel 20.

Figure 2:
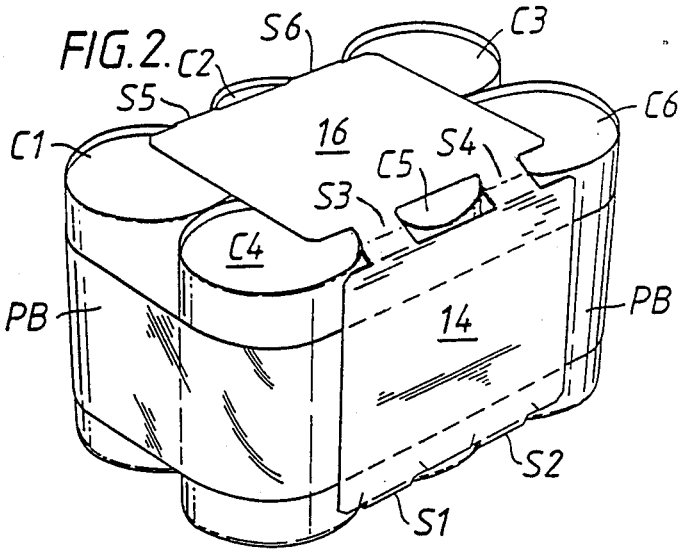
FIG. 2 is a perspective view of the completed package as seen from above and from one end, and incorporating the wrapper shown in FIG. 1.
Figure 3:
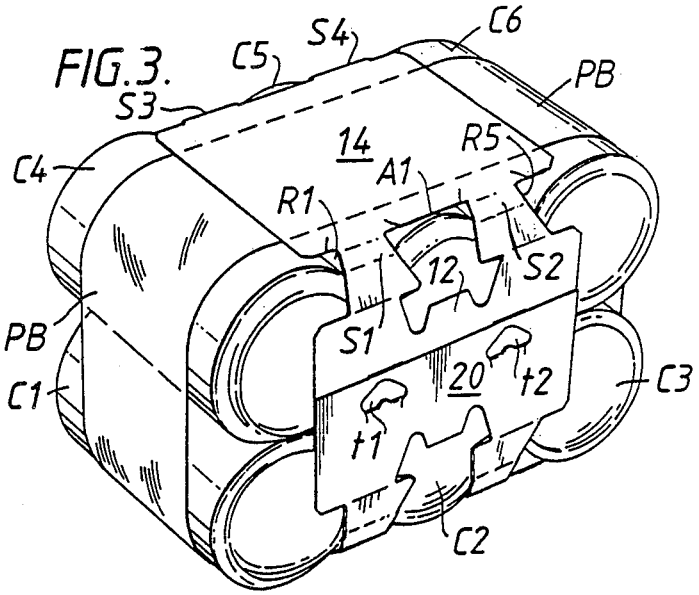
FIG. 3 is a perspective view of the completed package as seen from below and from end end, incorporating the wrapper shown in FIG. 1.

Referring now also to FIGS. 2 and 3, to form one package according to the invention, two rows of cans C1–C3 and C4–C6, or other primary containers, are secured together in a group by a band of plastics material 'PB'. The plastics band encircles the group intermediate the tops and bases of the cans as shown in FIGS. 2 and 3. The plastics band may be a polypropylene band which is applied to the cans by a strapping and sealing machine i.e. the band is preformed from a length of polypropylene material whose opposite ends are joined together and/or may be a shrink or stretch fitted plastics sleeve. Thereafter, the paperboard blank 10 is wrapped about the group so that the top panel 16 of the blank overlies the tops of the cans, the side panels 14 and 18 flank the side walls of the cans and overlie respective portions of the plastics band and the base panels 12 and 20 are secured together in overlapping relationship beneath the bases of the cans. In order to secure the base panels together, known locking means are provided which comprise male locking tabs t1, t2 in base panel 20 which are driven through locking apertures defined by retaining tabs t3, t4 in base panel 12. Tightening apertures 'TA' are formed in both base panels to tighten the wrapper around the container group and bring the complementary locking tabs and apertures into register.

When the wrapper blank is tightened about the container group, upper peripheral portions of the chines of cans C2 and C5 are located in apertures A3 and A1, respectively, while lower peripheral portions of the chines of cans C2 and C5 are located in apertures A4 and A1 respectively. Thus, the central cans C2 and C5 of the package are retained by the central series of apertures of the wrapper. Likewise, upper peripheral portions of the chines of cans C1, C4, C3 and C6 are located in edge recesses R3, R2, R7 and R6, respectively, while lower peripheral portions of the chines of those cans are located in edge recesses R4, R1, R8 and R5, respectively. Location of the can chines in this manner is brought about by causing the reinforced spacer portions of the blank to locate into the spaces present between the top ends and the base ends of adjacent cans.

For example, reinforced spacer portions S1 and S2 engage into the spaces at the lower ends of the cans C4–C5 and C5–C6 respectively, whereas reinforced spacer portions S5 and S6 engage into the spaces at the upper end of cans C1–C2 and C2–C3.

In this way, not only are the central cans C2 and C5 positively retained by apertures A4, A3; A2, A1 but also the reinforced spacer portions urge the containers apart so that the container group thereby exerts force on the plastics band tending to expand the band into tension around the container group. Further, in order to prevent relative movement of one row of cans relative to the other i.e. movement tending to cause nesting of the cans, the overlying areas of the plastics band and the paperboard wrapper may be secured together i.e. by gluing.

Figure 4:
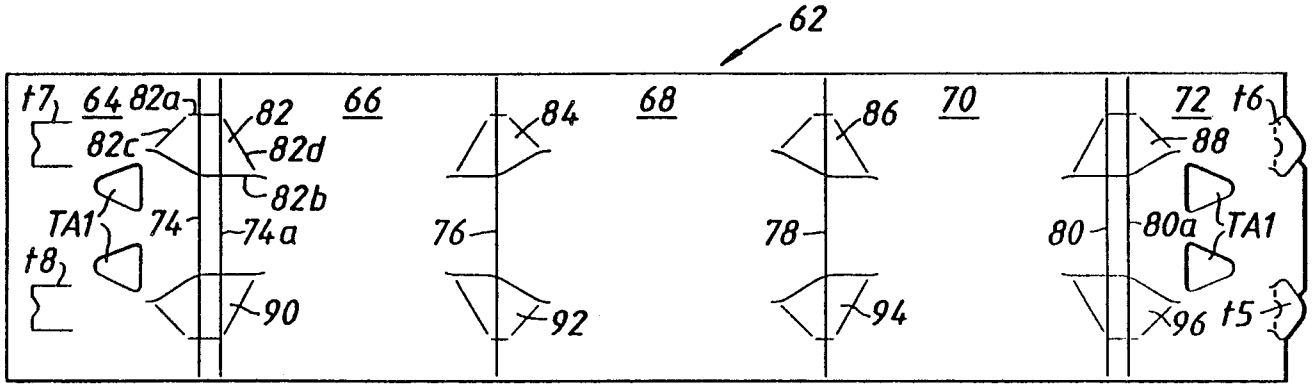
FIG. 4 is a plan view of a paperboard blank utilised in a package according to another embodiment of the invention to provide an outer wrapper.

Referring now to FIG. 4 of the drawings, another elongate blank 62 of paperboard or similar foldable sheet material comprises, in series, a first base panel 64, a first side wall panel 66, a top panel 68, a second side wall panel 70 and a second base panel 72 hinged one to the next along transverse fold lines 74/74*a*, 76, 78 and 80/80*a*.

Two series of spacer panels 82–88 and 90–96 comprising integral portions of the wrapper are struck from the blank across the hinged fold lines which connect together the main panels 64–72 of the blank. Thus, for example, spacer panel 82 is struck partially from base panel 64 and partially from side wall panel 66 by means of opposed cut lines 82*a*, 82*b* and opposed hinged lines 82*c*, 82*d*. The other spacer panels are similar.

Figure 5:
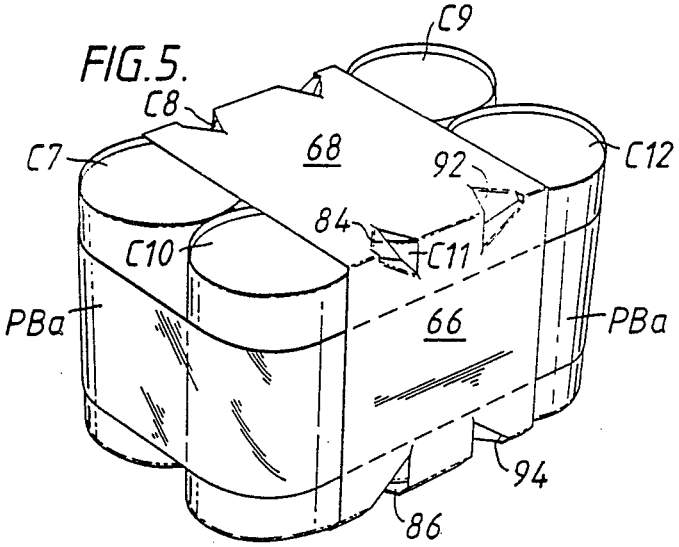
FIG. 5 is a perspective view of the completed package as seen from above and from one end incorporating the wrapper shown in FIG. 4.
Figure 6:
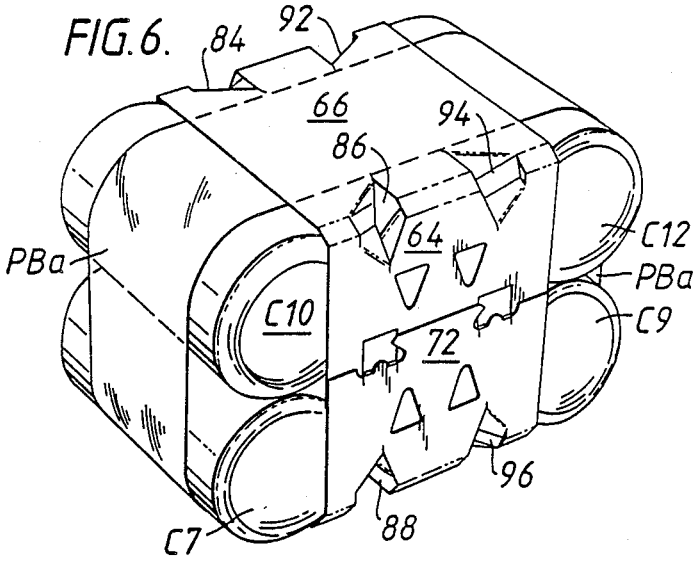
FIG. 6 is a perspective view of the completed package as seen from below and from one end incorporating the wrapper shown in FIG. 4.

Referring now also to FIGS. 5 and 6, to form one package according to the invention, two rows of cans C7–C9 and C10–C12, or other primary containers, are secured together in a group by a band of plastics material 'PBa'. The plastics band encircles the group intermediate the tops and bases of the cans as shown in FIGS. 5 and 6. The plastics band may be a polypropylene band which is applied to the cans by a strapping and sealing machine i.e. the band is pre-formed from a length of polypropylene material whose opposite ends are joined together and/or may be a shrink or stretch fitted plastics sleeve. Thereafter, the paperboard blank 62 is wrapped about the group so that the top panel 68 of the blank overlies the tops of the cans, the side panels 66 and 70 flank the side walls of the cans and overlie respective portions of the plastics band and the base panels 64 and 72 are secured together in overlapping relationship beneath the bases of the cans. In order to secure the base panels together, known locking means are provided which comprise male locking tabs t5, t6 in base panel 72 which are driven through locking apertures defined by retaining tabs t7, t9 in base panel 64. Tightening apertures 'TA1' are formed in both base panels to tighten the wrapper around the container group and bring the complementary locking tabs and apertures into register.

I claim:

1. A composite package for a group of containers such as cans having cylindrical side walls and substantially flat top- and bottom ends, said containers being arranged in at least two parallel rows so that the containers are longitudinally and transversely aligned in a generally rectangular formation, the package comprising a band of elastic plastic material encircling the periphery of said group intermediate the top and bottom ends of said containers and being placed under tension when applied, and a stabilizing means for maintaining said group in its generally rectangular formation comprising a paperboard wrapper extending around said group in a direction perpendicular to said band and comprising a top panel, side walls and base panel means joined together along fold lines, characterized in that said wrapper provides spacer elements disposed between adjacent containers in each of said rows and effective to maintain said containers in aligned relationship with each other whereby said band is maintained under tension.

2. The package according to claim 1, further characterized in that apertures are provided along said fold lines and arranged and sized so as to receive therethrough portions of said containers, said spacer elements being disposed between adjacent ones of said apertures.

3. The package according to claim 2, further characterized in that said spacer elements are reinforced by material removed from said apertures and folded into face contacting relationship with said spacer elements.

4. The package according to claim 1, further characterized in that said spacer elements are provided from portions of said top panel and adjacent side walls and disposed along said fold lines, said portions being displaced inwardly into the space between adjacent ones of said containers when the package is formed.

5. The package according to claim 4, further characterized in that each of said spacer elements is defined by a short cut traversing the respective fold lines and angular score lines extending from the ends of the cut to intersect said respective fold line.

6. The package according to claim 1, characterized in that said spacer elements are provided adjacent the top- and bottom ends of said containers.

7. The package according to claim 1, characterized in that the wrapper is secured to said band.

* * * * *